US005145272A

United States Patent [19]

Keil

[11] Patent Number: 5,145,272

[45] Date of Patent: Sep. 8, 1992

[54] PROJECTABLE AND RETRACTABLE, PUSH BUTTON WRITING INSTRUMENT

[75] Inventor: Georg Keil, Gross-Bieberau, Fed. Rep. of Germany

[73] Assignee: Merz & Krell GmbH & Co., Gross-Bieberau, Fed. Rep. of Germany

[21] Appl. No.: 739,812

[22] Filed: Aug. 2, 1991

Related U.S. Application Data

[63] Continuation of Ser. No. 497,355, Mar. 22, 1990, abandoned.

[30] Foreign Application Priority Data

Mar. 22, 1989 [DE] Fed. Rep. of Germany ..... 3909377

[51] Int. Cl.[5] ..... B43K 5/16; B43K 7/12; B43K 24/08

[52] U.S. Cl. ..... 401/112; 401/110

[58] Field of Search ..... 401/109, 110, 111, 112, 401/113, 114, 105, 106

[56] References Cited

U.S. PATENT DOCUMENTS 3,196,839 7/1965 Bertoglio et al. ..... 401/112
3,408,148 10/1968 Bross ..... 401/113
3,432,244 3/1969 Bross ..... 401/113
3,438,715 4/1969 Bross ..... 401/112

FOREIGN PATENT DOCUMENTS 201471 1/1959 Austria ..... 401/112
1189889 3/1965 Fed. Rep. of Germany ..... 401/112
1805851 8/1978 Fed. Rep. of Germany ..... 401/109
1445378 5/1966 France ..... 401/113

*Primary Examiner*—Danton D. DeMille
*Attorney, Agent, or Firm*—Michael J. Striker

[57] ABSTRACT

A writing instrument includes a reservoir, a barrel in which the reservoir is received for a longitudinal displacement between a retracted position and a writing position, a push button for actuating the reservoir, and a shift device for moving the reservoir between the positions in which the reservoir is latchable with spring biasing. The shift device has a controlling curved portion arranged fixedly in the barrel and a movable actuating device, the actuating device including the push button and at least one elastically deflectable shift rod arranged to latch with the insert and unlatch from the latter so that latching and unlatching movements of the shift rod are associated with different planes.

3 Claims, 6 Drawing Sheets

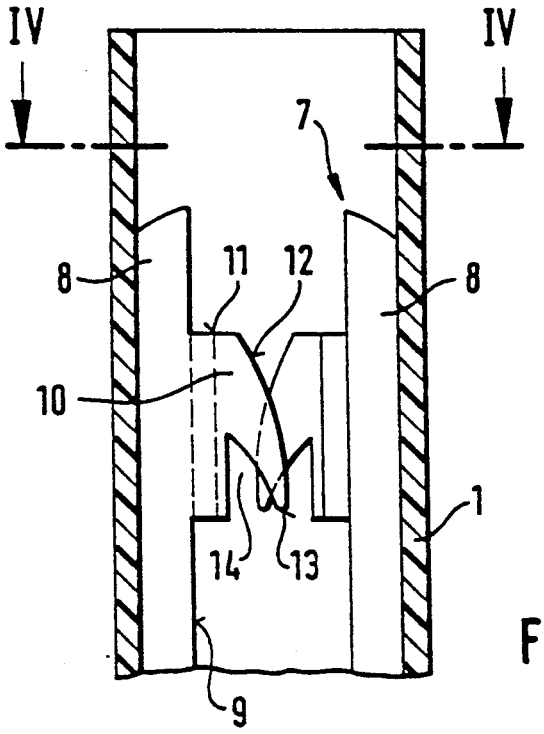
FIG. 3
FIG. 4
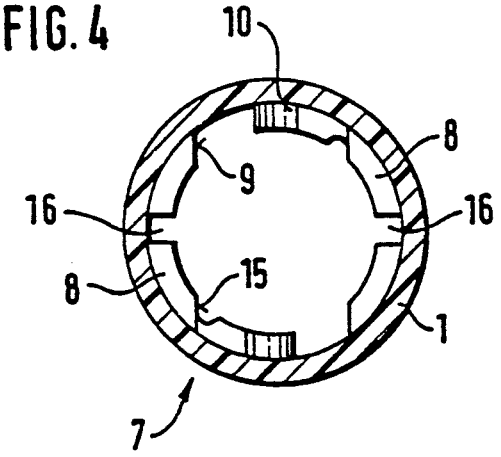

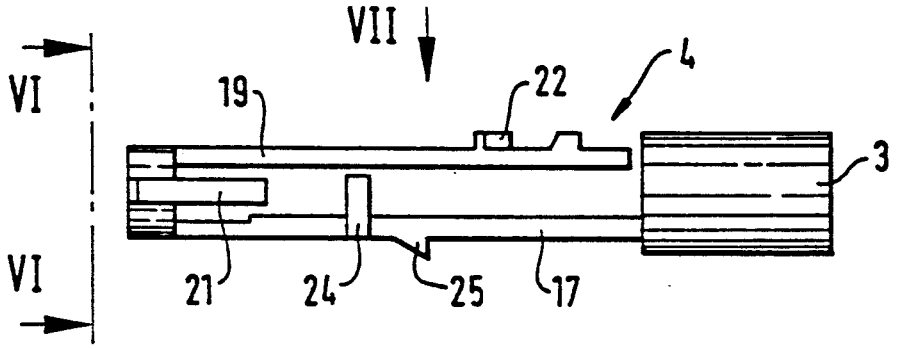
FIG. 5
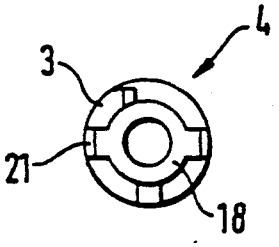
FIG. 6
FIG. 7
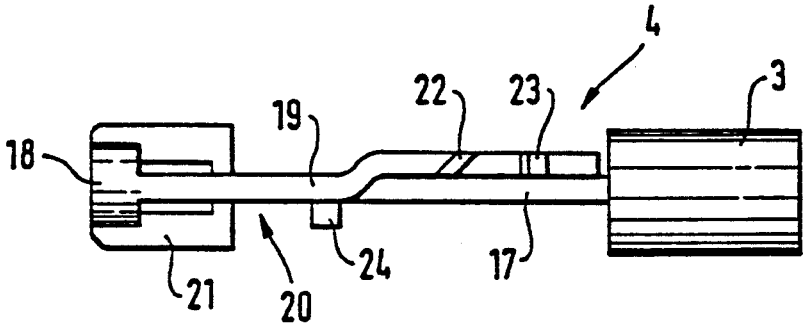

PROJECTABLE AND RETRACTABLE, PUSH BUTTON WRITING INSTRUMENT

This is a continuation, of application Ser. No. 497,355 filed Mar. 22, now abandoned.

BACKGROUND OF THE INVENTION

The present invention relates to writing instruments. More particularly, it relates to such writing instruments which have a reservoir or the like received within a barrel for longitudinal displacement between a retracted position and a writing position, a push button for activating the reservoir, and a shift device by means of which the reservoir is moved between these positions and in these positions is latchable with spring-bias assistance.

Many forms of mechanical shift devices for moving the reservoir of a ballpoint writing instrument from a retracted position to a writing position are known. These devices conventionally include components which are formed as injection molded plastic parts which, upon the actuation of a push button, cooperate together in a predetermined manner to effect the movement between the two positional settings. These devices can be further improved.

SUMMARY OF THE INVENTION

Accordingly, it is an object of the present invention to provide a writing instrument of the type above mentioned general type which is a further improvement.

More particularly, it is an object of the present invention to provide a writing instrument of this type in which the mechanics of its shift device is improved both from a constructional and manufacturing point of view, and a simple assembly is achieved.

According to the invention, the writing instrument comprises a reservoir; a barrel in which the reservoir is received longitudinally displaceable into and between a retracted position and a writing position; and means for shifting the reservoir between the retracted and the writing positions. The means for shifting includes an actuating device axially movable in and relative to the barrel and a controlling curved portion fixed in the barrel. The controlling curved portion is provided in a slot in an end of the barrel and is engagable with the actuating device.

The actuating device includes a push button axially movable relative to the barrel, a receiving device engagable with the reservoir, a connecting rod connecting the receiving device to the push button and a shift rod connected to the receiving device and having a shift tooth at an end remote from the receiving device, the shift rod being elastically deflectable in either of two planes perpendicular to one another. The reservoir is latchable in the retractable or the writing positions by action of the actuating device and the actuating device is nonrotatably movable in the barrel and is provided with a protruberance protruding through the slot of the barrel. This protruberance is movable in the slot with the reservoir in the retracted position, the slot having a narrowed portion for retaining the actuating device in the barrel under spring biassing. The controlling curved portion has an undercut defining a latched position of the shift tooth in which the shift tooth is held under action of the spring biassing, the latched position being defined by abutment of the shift tooth in the undercut so that, when the shift tooth is in the latched position, the actuating member holds the reservoir in the writing position.

The actuating device also includes a component connected to the connecting rod for holding the shift rod in one plane during displacement of the reservoir from the retracted position to the writing position and for holding the shift rod in the other plane during displacement of the reservoir from the writing position to the retracted position. The component advantageously extends substantially parallel to an additional plane passing through the connecting rod and the shift rod.

It is essential to the invention that the actuating device is formed in one piece so that the means for shifting the reservoir includes only two functional elements, namely an actuating device arranged movably within the barrel of the writing instrument on the one hand, and a controlling curved portion of the barrel arranged fixedly, i.e., non-displaceably within the barrel, on the other hand. The latter element comprises for example a split core of a curved shift unit (with two-part stem) or of a stem brake in the shape of the curved shift unit or of an insert in which the curved shift unit is formed. This gives a considerably simplification of the structural arrangement in comparison with the known conventional multi-part actuating devices, which leads also to a considerable simplification in the manufacture of these components. The actuating device cooperates with the controlling curved portion for the latching and the unlatching with a resiliently deflectable component so that by means of its elasticity one simultaneously achieves the effect of the restoring springs. Because the latching and unlatching of the components is associated with different movement planes, one has shift movements which are free from functional damage and are separated from each other and are kinematically guided in an unambiguous way. The geometry of the component as well as of the controlling curved portion which cooperates with it can take substantially any form.

In accordance with another feature of the present invention, the actuating device includes a push button, a receiving device for the reservoir, a connecting rod which connects the push button and the receiving device, and a shift rod extending from the receiving device to which shift teeth are fixed which can be brought into engagement in a form-locking manner with the insert corresponding to the particular shift position of the push button. The actuating device designed in accordance with these features is simple to realize from a constructional point of view. The push button, the connecting rod, the shift rod and the receiving device are preferably formed as a one-piece injection molded plastic part.

The controlling curved portion is provided in a slot extending parallel to the axis for guidance of one of the shift teeth, as well as for guidance of the actuating device in the retracted position. The controlling curved portion, according to these features is effective not only to deflect the shift teeth of the shift rod from a rest position in a predetermined manner, but it serves also for linear guidance of the shift rod.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a partial view showing essential parts of an insert of the writing instrument, in a longitudinal section and on an enlarged scale;

FIG. 4 is a view showing the insert in a section taken along the line IV—IV in FIG. 3;

FIG. 5 is a view, in side elevation, of the actuating device of the writing instrument of the present invention;

FIG. 6 is a view showing the actuating device in a section taken along the line VI—VI in FIG. 5;

FIG. 7 is a view of the actuating device of FIG. 5, as seen in direction of the arrow VII;

FIG. 12 shows a detailed view of the actuating device shown in the circled portion XII of FIG. 12 showing the shift tooth 32 engaged with the curved portion 10 in the retracted position; and FIG. 13 is a sectional view taken through the actuating device along section lines XIII—XIII of FIG. 11.

DESCRIPTION OF THE PREFERRED EMBODIMENTS

Figure 1:
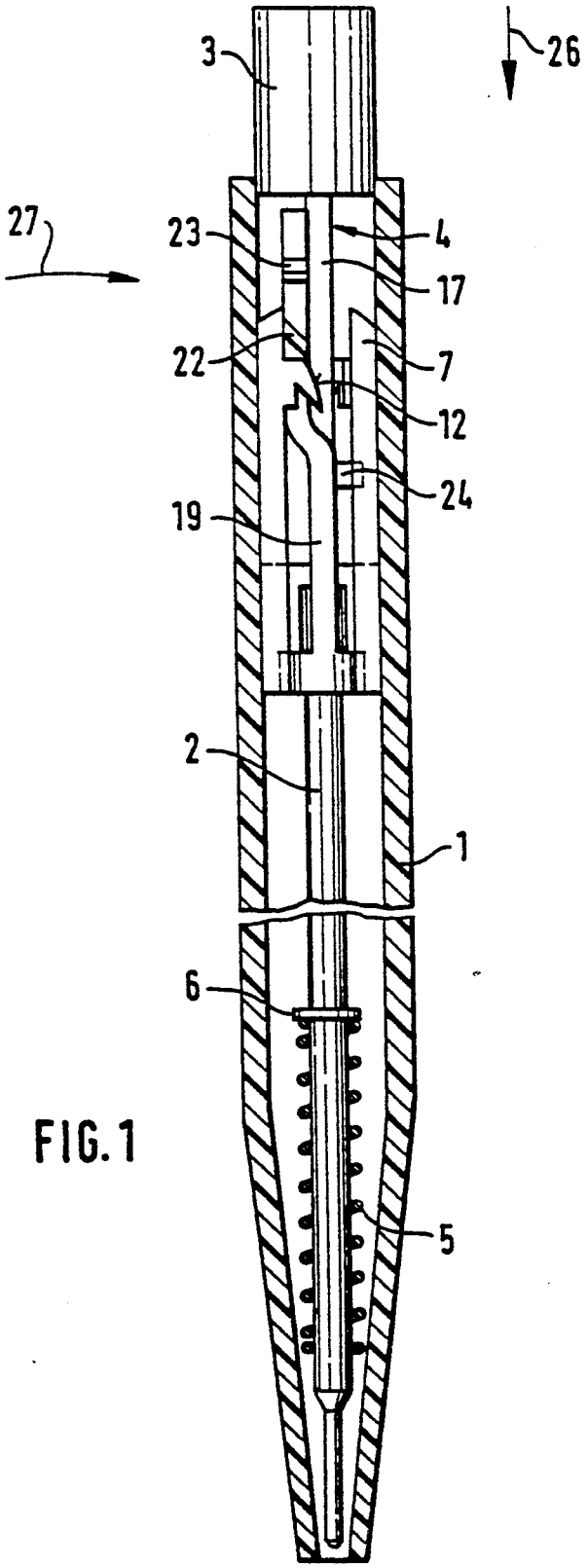
FIG. 1 is a view a showing a writing instrument in accordance with the present invention, with its reservoir located in a retracted position.

A ball-point writing instrument in accordance with the present invention has a barrel or a housing which is identified with reference numeral 1. Its reservoir 2 is located in a withdrawn or inactive position in FIG. 1.

At its end adjacent to a push button 3 the reservoir 2 is received in a not shown bore of an actuating device 4 which will be described in more detail hereinafter, and is stabilized in this position by means of a spring 5 in a manner known per se. The spring 5 is seated at its one end against a collar 6 on the reservoir 2 and is seated at its other end against the inside wall of the barrel 1 which is shaped conically at one end.

An insert 7 is located in the barrel 1 at its end adjacent to the push button 3. The insert 7 is mounted fixedly on the internal wall of the barrel 1, i.e., so that it is not to be displaceable. The insert will be described in detail hereinafter. It serves, in combination with the actuating device 4, to define two different rest positions for the reservoir 2, namely its retracted position and its writing position. For this purpose, the push button 3 is fixedly connected to the actuating device 4 and is preferably undetachable therefrom.

The insert 7 will now be described in more detail with particular reference to FIGS. 3 and 4. The insert 7 includes essentially two part-cylindrical shell portions 8 which are arranged in mutually opposing relationship against the inside of the barrel 1 and which are both the same in shape. A controlling curved portion 10 protrudes from a marginal face 9 of each shell portion which extends parallel to the longitudinal axis. The curved portion 10 has on its top side an abutment 11 which is perpendicular to the axis of the barrel 1 and extends peripherally around the inside of the barrel. A curved running surface 12 of the curved portion (10) extends from the abutment 11 and slopes progressively more and more in the axial direction and also extends in a peripheral direction. The running surface 12 extends as far as a lowest point 13 and forms, starting from there an undercut 14, the purpose of which will be described later. A groove 15 extends in the inner surface of the curved portion 10 immediately adjacent to the marginal face 9 and runs parallel to the main axis. Two further grooves 16 are arrange don the inner surface of the insert 7 and located diametrically opposite each other.

The actuating device 4 is described with reference to FIGS. 5–7. The actuating device 4 is a one-piece structure. It includes a connecting rod 17 which is connected at its one end to the push button 3 and which is provided at its other end with a cylindrical receiving device 18 for the reservoir 2, not shown here. The push button 3 and the receiving device 18 are located in a coaxial arrangement.

A shift rod 19 is secured to the receiving device 18 to the peripheral region of the receiving device, like the connecting rod 17. The connecting rod 17 and the shift rod 19 extend, starting from the receiving device 18, parallel to each other over a first section 20, and at the end of the section 20 the shift rod 18 has a crooked portion with the section which follows the crooked portion again running parallel to the connecting rod 17. The last mentioned section of the shift rod 19 constitutes its actual shift portion, to which further reference will be made in the following description.

A plate portion 21 extends perpendicular to the plane containing the connecting rod 17 and the section 20 of the shift rod 19. The plate portion 21 is secured to the receiving device 18 and is dimensioned so as to make shape-fitting engagement with the grooves 16 of the insert 7. In combination with the grooves 16, the plate portion 21 provides for non-twisting linear guidance of the actuating device 4 within the barrel 1.

The shift rod 19 carries a first shift tooth 22 at its end which is remote from the receiving device 18. A second shift tooth 23 is formed on the shift rod 19 and located between the shift tooth 22 and the free end of the shift rod 19. These shift teeth 22 and 23 are dimensioned to cooperate with the curved portion 10.

Finally, a rectangular component 24 of the support is secured to the connecting rod 17 and extends perpendicular to the plane of the plate portion 21. This support is provided to receive the shift rod 19 and prevent the shift tooth 22 from sliding under it during the transfer of the reservoir 2 into the writing position. During the retraction stroke, i.e., during the motion into the rest position, the support prevents the shift tooth 22 from sliding back into the undercut 14. A cam 25 is fixed on the connecting rod 17. The cam 254 fulfills a stop function and cooperates with the insert 7.

In the rest position shown in FIG. 1, the actuating device 4 is held in its position by means of the spring 5 as well as by means of the cam 25 engaging with an edge of the insert 7. If now the push button 3 is moved in the direction of the arrow 26 the shift tooth 22 first slides on the curved portion 10, which causes a deflection of the shift rod 19 in direction of the arrow 27, until with further continuance of this deflection movement, the shift tooth 22 finally reaches and passes the lowest point 13 of the curved portion 12 and snaps elastically into the undercut 14. During the deflection movement of the shift rod 19 by means of the component 24 which in this shift phase limits movement in the plane of the drawing according to FIG. 5, one insures that there is a trouble-free guidance of the shift tooth 22 along the running surface 12 and in particular that one achieves a reliable contact engagement between the shift tooth 22 and the running surface 12. By means of the abutment 11 of the curved portion 10, a stop for the depression movement of the push button 3 is provided. The shift tooth 22 after release of the push button 3, takes up its final position characterized by a latching engagement with the undercut 14, in which position the reservoir 2 is located in the writing position shown in FIG. 2. In the writing position the shift rod 19 is deflected relative to its rest position and consequently is under a stress, by means of which the position of the shift tooth 22 in the undercut 14 is insured.

Figure 2:
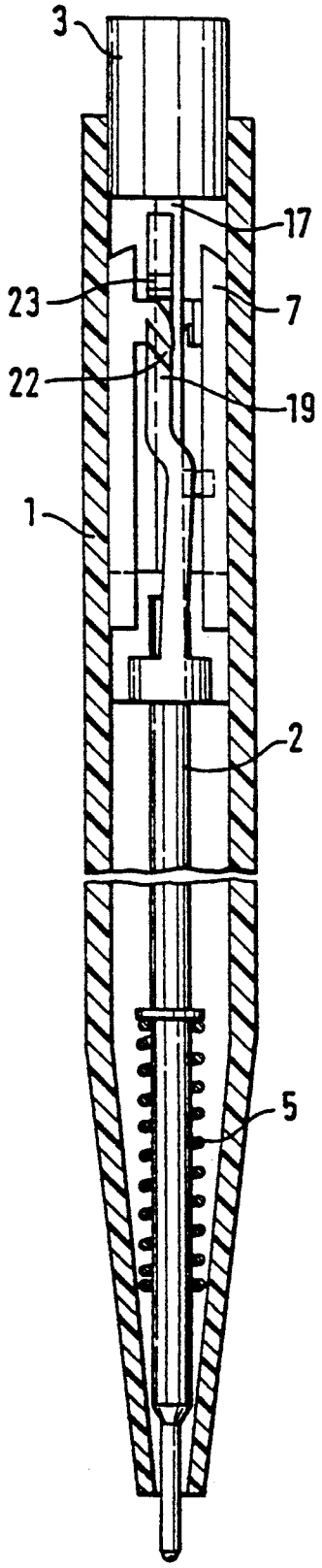
FIG. 2 is a view showing a writing instrument in accordance with the present invention, with its reservoir located in a writing position.

The writing position shown in FIG. 2 is additionally characterized by the fact that the shift rod 19, by means of the undercut 14 in combination with the shift tooth 22 is fixed in a position in which, when the push button 3 is actuated again, the shift rod 19 is deflected perpendicular to the plane of the drawings of FIG. 2 by means of the second shift tooth 23, so that the engagement of the shift tooth 22 with the undercut 14 because of the stress on the shift rod 19 is released, the shift tooth 22 springs out into the groove 15, and the actuating device is transferred to the rest position shown in FIG. 1 under the action of the spring 5.

The aforesaid shift sequence naturally presupposes an appropriate shaping of the curved portion 10 as well as of the undercut 14, such that in the initial transfer into the writing position one always has a pivoted position of the shift rod 19 in which by means of the component 24 a deflection of the shift rod perpendicular to the plane of the drawing of FIG. 2 is prevented. Such a deflection is consequently first possible in the position of the shift rod 19 which is shown in FIG. 2. While the shift tooth 22 is the essential cause for producing a pivot movement of the shift rod 19 in the direction of the arrow 27, the second shift tooth 23 is effective to produce a pivot movement of the shift rod 19 in a plane perpendicular thereto, namely perpendicular to the plane of the drawing of FIGS. 1 and 2. This assumes the provision of respective shift surfaces on the aforesaid shift teeth 22 and 23 which are inclined in the said pivot plane.

It will be appreciated from the foregoing description that the components required for the operation of the writing instrument according to the invention consist solely of a movable element formed by the aforesaid actuating device and an element arranged fixedly in the barrel and formed by the aforesaid insert, so that a rapid and simple assembly of the instrument is possible. The parts required for the actuation of the writing instrument according to the invention are additionally characterized by simplicity of operation and trouble-free location in the respective shift positions.

FIGS. 8 to 11 show a further embodiment of a writing instrument in accordance with the invention by way of example. Functional components here which correspond with those of FIGS. 1 to 7 are given the same reference numerals.

Figure 10:
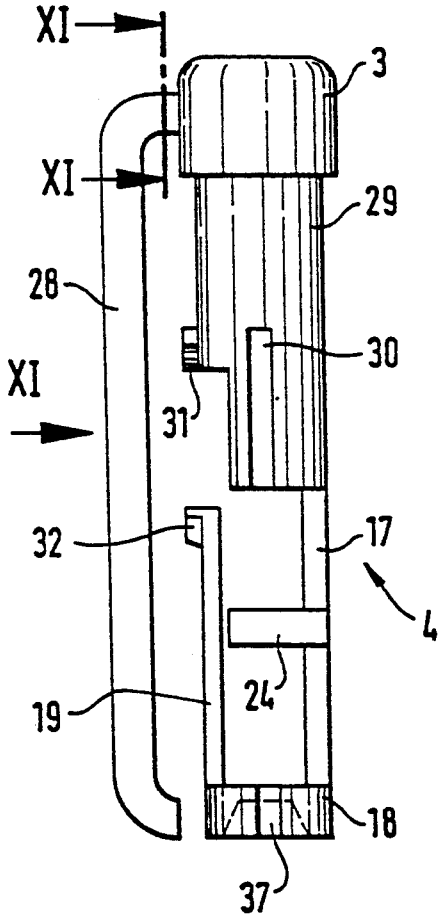
FIG. 10 is a view of a further embodiment of an actuating device for the writing instrument.
Figure 11:
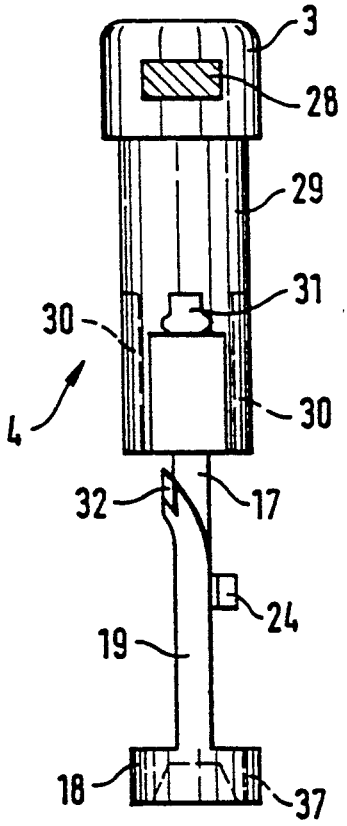
FIG. 11 is a side view of the actuating device of FIG. 10 viewed in the direction of the arrow XI, and including a partial sectional view taken along the line 11—11.

The actuating device 4 according to FIGS. 10 and 11 includes a push button 3 to which a clip 28 is directly connected. At its end which is adjacent to the receiving device 18, the push button 3 has a radially thinner section 29 to which the connecting rod 17 is directly connected.

The section 29 is provided at its end adjacent to the receiving device 18 with two diametrically opposed grooves 30 which are arranged in a common plane extending perpendicular to the plane containing the connecting rod 17 and the shift rod 19. In a manner which is to be described hereinafter the grooves 30 serve for the axial, non-rotational guidance of the actuating device 4 within the barrel 1.

A protuberance 31 projects radially out from the surface of the section 29 of the push button 3 and in a manner to be described serves to limit the displacement of the actuating device 4 within the barrel 1.

The shift arm 19 which is arranged for the most part in the same plane as the clip 28 carries at its end which is adjacent to the push button 3 a shift tooth 32. The end of the shift tooth 32 again is displaced from the plane containing the connecting rod 17 and the greater part of the shift rod 19. A support which is provided by a rectangular component 24 and which is formed on the connecting rod 17 extends substantially parallel to the plane containing the connecting rod 17 and the shift rod 19 and is otherwise arranged to correspond to the support shown in the embodiment of FIGS. 1 to 7.

An insert 7 is arranged within the barrel 1 and again consists of two shell portions which are established immovably within the barrel 1. The insert 7 additionally comprises, once again, a controlling curved portion 10 whose undercut 14 is dimensioned for elastic latching with the shift tooth 32 of the shift rod 19 in the writing position of the reservoir 2.

A slot 33 is provided in barrel 1 extending parallel to the main axis and between the shell portions 8. The slot 33 has a narrowed or constricted portion 34 adjacent the end of the barrel 1. The narrowed portion 34, in combination with the protuberance 31, is dimensioned in such a way that it limits the displacement of the push button 3 in direction of the arrow 35.

Two guide ribs 36 arranged diametrically opposed to each other within the barrel 1 and in contact with the inside of the barrel serve, in combination with the grooves 30, for the nonrotatable guidance of the actuating device 4 within the barrel. Further grooves 37 are arrange din the receiving device 18. They are diametrically opposed to each other and are arranged in a common plane with the aforementioned grooves 30 of the section 29. Consequently, the actuating device 4 experiences a nonrotatable guidance by the grooves 30 and 37.

Figure 8:
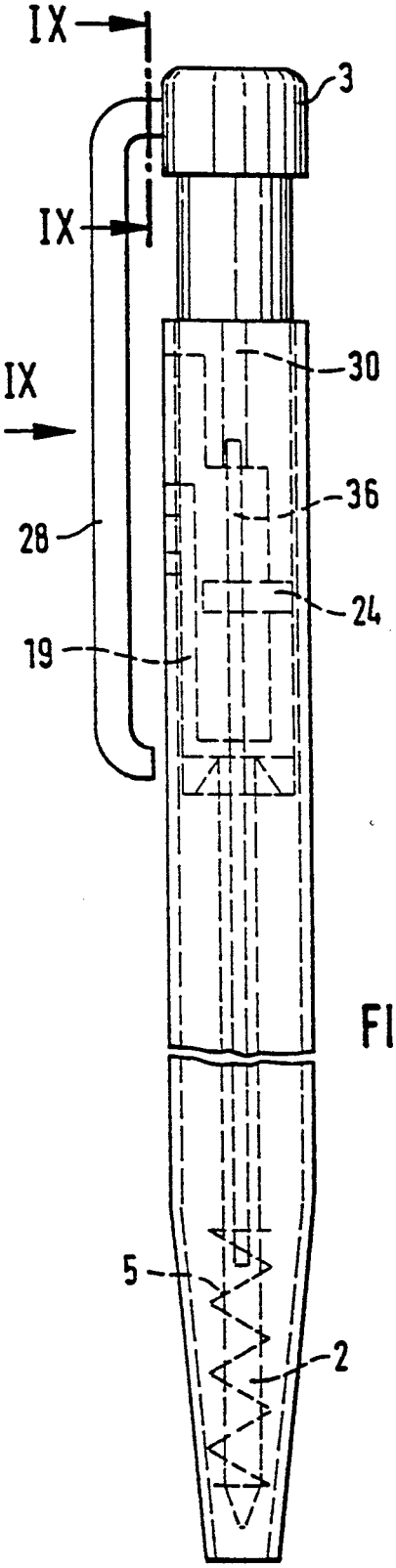
FIG. 8 is a view showing a further embodiment of the writing instrument in accordance with the present invention with its reservoir located in a retracted position.
Figure 9:
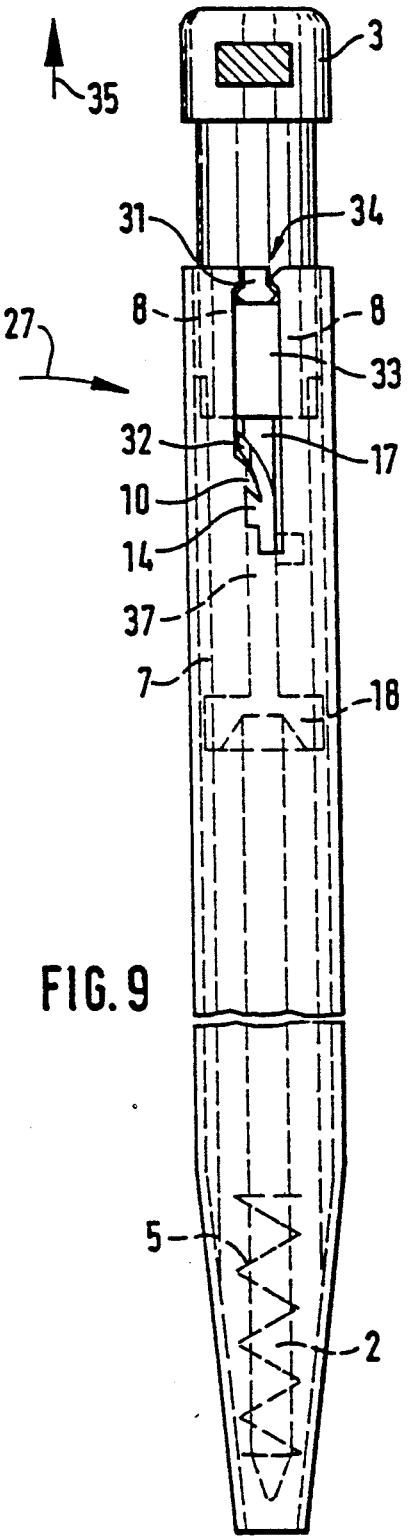
FIG. 9 is a side view of the writing instrument of FIG. 8 viewed in the direction of the arrow IX and incorporating a partial sectional view taken along the line IX—IX in FIG. 8.

The operation of the actuating device 4 and the motion of the shift rod 19 in each of two mututally perpendicular planes during retraction and actuating is shown in better detail in FIGS. 12 and 13 as well as in FIGS. 8 and 9.

In the retracted position shown in FIGS. 8 and 9 the reservoir 2 and consequently also the actuating device 4 is fixed in position elastically by the spring 5 with cooperation between the protuberance 31 and the narrowed portion 34. Upon actuation of the push button 3 in the direction opposite to the arrow 35 there first occurs a deflection of the shift arm 19 and consequently of the shift tooth 32 in the direction of the arrow 27 with that deflection movement taking plane in the plane of the drawing of FIG. 9 and perpendicular to the plane of the drawing of FIG. 10 along the line 41 in FIG. 13. During this deflection movement, as in the embodiment described earlier, the shift tooth 32 slides over the running surface of the curved portion 10 in order finally to engage elastically in the undercut 14 after release of the push button 3. In this writing position of the reservoir 2 the shift rod 19 is consequently deflected slightly in the direction of the arrow 27 in the plane of FIG. 9 and thus experiences a certain tensioning. The aforesaid support formed by the component 24 guides shift rod 19 along line 41 in FIG. 13 and ensures a trouble-free latching of the shift tooth 32 with the undercut 14 during the last mentioned shift movement.

When the push button 3 is again actuated in the direction opposite to the arrow 35 there occurs a deflection of the shift rod 19 perpendicular to the plane of the drawing of FIGS. 9 and 11 along the plane indicated by line 51 in FIG. 13, and indeed to such a degree that the latching of the shift tooth 32 with the undercut 14 is released. This is because in the position of the shift rod 19 with the shift tooth 32 latched in the undercut the shift rod is under tension so that an additional depression of the push button forces the shift tooth 32 below control edge 50 and thus the unlatched shift rod 19 moves in the plane perpendicular to the plane indicated by 41 in FIG. 13. In this movement phase, by means of the component 24, a renewed latching with the undercut 14 is prevented, so that the shift rod 19 returns to its unstressed position and the push button 3 returns to the retracted position shown in FIGS. 8 and 9. The deflection of the shift rod 19 in the last mentioned sense is effected by a shift edge 50 which is formed on the insert 7 and on which the shift tooth 32 slides.

The push button 3 itself serves as an axial insertion limiter for the actuating device, in the embodiment shown in FIGS. 8 and 9. This is because the push button 3 has a larger diameter than the section 29, and upon pushing in the push button 3 in the direction opposite to the arrow 35 it comes up against the end of the barrel 1.

It will be understood that each of the elements described above, or two or more together, may also find a useful application in other types of constructions differing from the types described above.

While the invention has been illustrated and described as embodied in a writing instrument, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A writing instrument comprising:

a reservoir (2);

a barrel (1) in which said reservoir (2) is received longitudinally displaceable into and between a retracted position and a writing position; and means for shifting said reservoir between said retracted and said writing positions; wherein said means for shifting includes an actuating device (4) axially movable in and relative to said barrel (1) and a controlling curved portion (10) fixed in said barrel (1), said controlling curved portion (10) being provided in a slot (34) opening onto an end of said barrel (1) and being engagable with said actuating device;

said actuating device including a push button (3) axially movable relative to said barrel (1), a receiving device (18) engagable with said reservoir (2), a connecting rod (17) connecting said receiving device to said push button and a shift rod (19) connected to said receiving device and said shift rod having a shift tooth (32) at an end remote from said receiving device, said shift rod being movable in two planes perpendicular to one another, said actuating device being formed in one piece; wherein said reservoir is latchable in each of said retractable and said writing positions by action of said actuating device (4) and said actuating device is nonrotatably movable in said barrel and is provided with a protruberance (31) extending into said slot of said barrel (1), said protruberance being movable in said slot with the reservoir in the retracted position, said slot having a narrowed portion for retaining said actuating device in said barrel under spring biassing; and wherein said shift rod (19) is elastically deflectable in one of said planes;

and wherein said controlling curved portion (10) has an undercut (14) defining a latched position of said shift tooth (32) in which said shift tooth (32) is held under action of the spring biassing, said latched position being defined by abutment of said shift tooth (32) in said undercut (14) and, when said shift tooth (32) is in said latched position, said actuating device holds said reservoir in said writing position; and wherein said shift rod (19) is deflectable into the other of said two planes perpendicular to said one plane to move said reservoir (2) from said writing position to said retracted position for releasing said shift tooth (32) from said undercut (14), and wherein said actuating device also includes a component (24) connected to said connecting rod for guiding said shift rod (19) in said one plane during displacement of said reservoir from said retracted position to said writing position and for guiding said shift rod (19) in said other plane during displacement of said reservoir (2) from said writing position to said retracted position, said component extending substantially parallel to an additional plane passing through the connecting rod (17) and the shift rod (19).

2. A writing instrument as defined in claim 1, wherein said shift device also includes an insert (7) arranged fixedly in said barrel (1) and said controlling curved portion (10) is provided on said insert.

3. A writing instrument as defined in claim 1, wherein said push button and said receiving device of said actuating device are provided with grooves so that said actuating device is nonrotatably guided in said insert (7).

* * * * *